US006468366B1

(12) United States Patent
Katsuda et al.

(10) Patent No.: US 6,468,366 B1
(45) Date of Patent: Oct. 22, 2002

(54) SURFACE NITRIDING MEMBER

(75) Inventors: Yuji Katsuda, Tsushima; Taketoshi Tsutsumi, Kuwana-Gun; Masaaki Masuda, Nagoya, all of (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 09/568,500

(22) Filed: May 11, 2000

(30) Foreign Application Priority Data

May 11, 1999 (JP) ..... 11-129433

(51) Int. Cl.[7] ..... C23C 8/00
(52) U.S. Cl. ..... 148/317; 148/437
(58) Field of Search ..... 148/437, 238, 148/317

(56) References Cited

U.S. PATENT DOCUMENTS 5,272,015 A * 12/1993 Hamdi et al. ..... 428/472
5,514,225 A * 5/1996 Yamada et al. ..... 148/238
5,888,269 A * 3/1999 Yamada et al. ..... 75/252
5,989,734 A * 11/1999 Miura et al. ..... 428/656

FOREIGN PATENT DOCUMENTS

JP 60-211061 10/1985
JP 7-166321 6/1995
JP 10-102230 A * 4/1998

* cited by examiner

*Primary Examiner*—Roy King
*Assistant Examiner*—Janelle Combs-Morillo
(74) *Attorney, Agent, or Firm*—Parkhurst & Wendel LLP

(57) ABSTRACT

A nitriding portion made of aluminum nitride as a main ingredient having a high concentration region in which an element mentioned below is existent at a high concentration and a low concentration region in which the element existent at a low concentration is formed on a surface of a substrate made of aluminum, aluminum alloy or aluminum-containing composite material by existing at least one element other than aluminum selected from Group 2A, Group 3A, Group 4A and Group 4B in Periodic Table in a stepwise manner. Thereby, it is possible to form the nitriding portion which shows a high corrosion resistance property with respect to a halogen-based corrosive gas.

6 Claims, 1 Drawing Sheet

(1 of 1 Drawing Sheet(s) Filed in Color)

SURFACE NITRIDING MEMBER

BACKGROUND OF THE INVENTION

1. Field of the Invention

The present invention relates to a surface nitriding member, and particularly relates to a surface nitriding member used preferably as a member such as semiconductor producing devices and liquid crystal producing devices which requires a corrosion resistance property.

2. Description of Related Art

As wiring in the semiconductors and liquid crystal panels become finer, fine workings with dry processing are progressing. With the demand for such fine workings, a halogen-based corrosive gas is used as a film forming gas or an etching gas for the semiconductors or the like.

On the other hand, it is known that aluminum nitride exhibits high corrosion resistance against such a halogen-based corrosion gas. Therefore, members having aluminum nitride on their surfaces have been used in the semiconductor producing devices, the liquid crystal panel producing devices and so on.

When aluminum contacts air, its surface is oxidized to form a thin oxidized film. Since the oxidized film is an extremely stable passive phase, the aluminum surface can not be nitrized by a simple nitriding method. Under the circumstances, the following methods have been developed to modify the surface of aluminum and form aluminum nitride thereon.

Japanese Patent Laid-Open Publication No. 60-211061 (JP-A-60-211,061) discloses a method in which, after the inner pressure of the chamber is reduced to a given pressure, hydrogen gas is introduced therein to perform a discharging. Such a discharging is effected to heat the surface of the member such as aluminum. Then, argon gas is introduced therein and discharging is effected to activate the surface of the member, and the surface of the aluminum member is subjected to an ion nitriding by introducing nitrogen gas.

Japanese Patent Laid-Open Publication No. 7-166321 (JP-A-7-166,321) discloses a method in which a nitriding aid made of aluminum powder is contacted with the surface of the aluminum, and aluminum nitride is formed on the surface of the aluminum nitride by heating it in the nitrogen gas atmosphere.

However, according to the method described in JP-A-60-211,061, since aluminum nitride is formed by using the discharging, there is a drawback such that the entire device is complicated and thus a producing cost is increased. Further, there is also a drawback such that it is difficult to apply this method for nitride members having complicated shapes and large sizes.

Further, according to the method described in JP-A-7-166,321, since the nitriding aid is used, voids exist in a resulting surface layer of aluminum nitride so that denseness is not sufficient. For this reason, it is an actual situation that corrosion resistance against the halogen-based corrosive gas is not sufficient and it cannot be said to be practically satisfactory.

SUMMARY OF THE INVENTION

It is an object of the present invention to provide a surface nitriding member in which a nitriding member having a high corrosion resistance property with respect to a halogen-based corrosive gas is formed on its surface.

According to the invention, a surface nitriding member comprises a substrate made of metallic aluminum, aluminum alloy or aluminum-containing composite material, and a nitriding portion formed by nitriding a surface portion of the substrate, wherein the nitriding portion contains at least one element other than aluminum selected from Group 2A, Group 3A, Group 4A and Group 4B in Periodic Table and wherein a concentration of the element at a surface side of the nitriding portion is lower than that of the element at a substrate side of the nitriding portion.

These and other objects, features and advantages of the invention will be appreciated upon reading of the following description of the invention when taken in conjunction with the attached drawings, with understanding that some modifications, variations and changes of the same could be easily made by the skilled person in the art to which the invention pertains.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

DESCRIPTION OF THE PREFERRED EMBODIMENT

Figure 1:
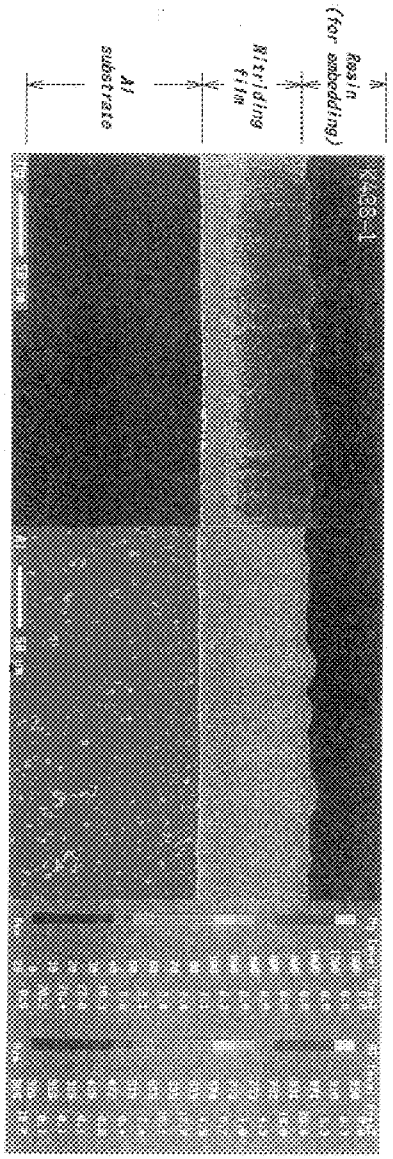
FIG. 1 is a diagram showing a cross section composition analyzing map of a surface nitriding member according to the invention obtained by EPMA.

The present inventors have repeatedly conducted investigations to form a nitriding portion having a high corrosion resistance property with respect to a halogen-based corrosive gas. As a result, the present inventors found that an extremely dense aluminum nitride could be formed by heating a substrate containing at least metallic aluminum in vacuum and heating and nitriding the substrate in vacuum in the presence of at least one element selected from Group 2A, Group 3A, Group 4A and Group 4B in Periodic Table, so as to promote the nitriding of the substrate surface, and this producing method was filed in Japan as Japanese Patent Application No. 11-27,924.

However, even in the producing method mentioned above, the resulting member showed some drawbacks such that a thickness of a nitriding portion made of aluminum nitride formed on the surface of the substrate became lower than a predetermined value and that, in the case that the substrate containing the element other than aluminum at a relatively high concentration, a corrosion resistance property was deteriorated.

The present inventors have further conducted investigations to solve the above drawbacks. That is to say, the investigations were performed in detail for a structural difference between the member in which the nitriding portion made of aluminum nitride was formed relatively thick and the member in which the nitriding portion was formed relatively thin, and for a composition distribution of the nitriding portion.

As a result, in the case that the nitriding portion was formed relatively thick, it was found that magnesium that was an element of Group 2A in Periodic Table or silicone that was an element of Group 4B in Periodic Table were existent locally at a substrate side of the nitriding portion. In addition, in the case that the nitriding portion was formed relatively thin, it was found that the above elements were existent evenly in the entire nitriding portion along a thickness direction.

From these results, such an remarkable reason was found that magnesium that was an element of Group 2A in Periodic Table or silicone that was an element of Group 4B in Periodic Table, both of which were contained in the nitriding portion made of aluminum nitride, deteriorated the corrosion resistance property of the nitriding portion with respect to the halogen-based corrosive gas.

That is to say, it was found that a contradiction result occurred such that, if for example an element of Group 2A in Periodic Table, that was in presence during the heating/nitriding treatment for promoting the nitriding of the substrate, was contained in the nitriding portion, such an element deteriorated the corrosion resistance property of the nitriding portion with respect to the halogen-based corrosion gas.

Accordingly, the present inventors thought an idea on the basis of the investigation results mentioned above such that the corrosion resistance property of the nitriding portion with respect to the halogen-based corrosive gas could be improved by decreasing an concentration of the element selected from for example Group 2A in Periodic Table at a surface side of the nitriding portion.

FIG. 1 is a diagram showing a mapping result in which a composition analysis is performed with respect to a cross section of a surface nitriding member by using EPMA. As can be seen from FIG. 1, it is understood that a nitriding portion including aluminum nitride having a thickness of 85 μm as a main phase is formed on an aluminum substrate. Moreover, it is understood that a high concentration region including high concentration magnesium is formed at a portion 25 μm apart from the aluminum substrate of the nitriding portion. Further, it is understood that a low concentration region including low concentration magnesium is formed at a surface side of the nitriding portion.

Then, such a surface nitriding member shows a higher corrosion resistance property with respect to the halogen-base corrosive gas as compared with a surface nitriding member in which magnesium is uniformly included in a nitriding portion along a thickness direction, as shown in the following examples.

Hereinafter, the present invention will be explained in detail with reference to the embodiment.

In the surface nitriding portion according to the invention, it is necessary to control a concentration of at least one element other than aluminum selected from Group 2A, Group 3A, Group 4A and Group 4B in Periodic Table to be low at a surface side of the nitriding portion and high at a substrate side of the nitriding portion.

If only the above requirement can be satisfied, an existent state of the element is not limited. However, as shown in FIG. 1, it is preferred that a concentration of the element is varied stepwise from the substrate side to the surface side in the nitriding portion. Moreover, it is preferred that the nitriding portion comprises the high concentration region positioned at the substrate side thereof and the low concentration region positioned at the surface side thereof. Under such circumstances, since a concentration of the element can be decreased at the surface side of the nitriding portion contacted to the halogen-base corrosive gas, it is possible to further improve the corrosion resistance property with respect to such a gas.

It should be noted that a term "stepwise" means a situation such that the element is existent in a region having a thickness of about 10 μm in such a manner that a concentration thereof is abruptly varied in a stepwise manner.

In this case, it is not always necessary to exist the element stepwise along a thickness direction in the nitriding portion, but, for example, it is also Possible to exist the element in the nitriding portion in such a manner that a concentration of the element is continuously varied from the substrate side to the surface side. Also in this case, an object of the present invention can be satisfied sufficiently.

Moreover, in the case that the nitriding portion has the high concentration region and the low concentration region, it is preferred that a thickness of the low concentration region is not less than one third of, more preferably not less than a half of, a thickness of the entire nitriding portion. In this case, it is possible to further improve the corrosion resistance property of the nitriding portion with respect to the halogen-based corrosive gas.

Further, it is preferred that a concentration of the element in the low concentration region is not more than 0.5 wt % more preferably not more than 0.3 wt %. In this case, as is the same as the preferable embodiment just mentioned above, it is possible to further improve the corrosion resistance property of the nitriding portion with respect to the halogen-based corrosive gas.

It should be noted that a lower limit of the element concentration in the low concentration region is about 0.01 wt % due to a producing method of the surface nitriding member according to the invention which is explained hereinafter.

Moreover, it is preferred that a concentration difference between the high concentration region and the low concentration region is not less than 0.1 wt % more preferably not less than 0.3 wt %. When the high concentration region and the low concentration region in the nitriding portion include the element selected from for example Group 2A in Periodic Table in such a manner as mentioned above, it is possible to form a dense nitriding portion, while the advantages of JP-A-11-27,924 can be sufficiently obtained. Further, the object of the present invention can be achieved more effectively.

In order to improve the corrosion resistance property of the surface nitriding member with respect to the halogen-based corrosive gas and to achieve the present invention satisfactorily, it is preferred that a thickness of the nitriding portion is not less than 10 μm more preferably not less than 20μm.

Moreover, an upper limit of a thickness of the nitriding portion is not particularly limited. However, it is preferred that a thickness of the nitriding portion is not more than 200 μm if considering an abruption of the nitriding portion due to an inner stress of the nitriding portion generated on the basis of various conditions during a formation of the nitriding portion. Further, even if a thickness of the nitriding portion is made more thicker, the corrosion resistance property with respect to the halogen-based corrosive gas is not improved so much.

As the same reason as mentioned above, it is preferred that a concentration of at least one element in the nitriding portion other than aluminum selected from Group 2A, Group 3A, Group 4A and Group 4B in Periodic Table is not more than 1 wt % more preferably not more than 0.5 wt %.

Moreover, in the nitriding portion of the surface nitriding member according to the invention, it is necessary to include the element mentioned above, and there is a lower limit of a concentration of the element. However, the lower limit of the element is due to the producing method which is explained later, and it is not basic for the present invention. That is to say, in the nitriding portion, it is preferred that a concentration of the element is lower and lower, and ideally it is more preferred that there is no element therein. From the view point mentioned above, it is preferred that a lower limit of the element in the low concentration region mentioned above is basically lower and lower, and ideally it is more preferred that there is no element therein.

Further, it is preferred that a surface roughness of the nitriding portion generated on the surface of the surface nitriding member according to the invention is not more than 1.6 μm more preferably not more than 0.8 μm when expressed by an average surface roughness along center line. In this manner, if the smooth and dense nitriding portion is formed on the substrate surface, it is possible to further improve the corrosion resistance property with respect to the halogen-based corrosion gas of the surface member according to the invention.

Furthermore, due to the producing method mentioned above, a lower limit of the surface roughness of the nitriding portion is about 0.05 μm when expressed by an average surface roughness along center line.

As the substrate used in the surface nitriding portion according to the invention, it is necessary to use aluminum, aluminum alloy or aluminum-containing composite material. Thereby, it is possible to construct the nitriding portion by aluminum nitride which shows a high corrosion resistance property with respect to the halogen-base corrosive gas.

As for the aluminum alloy, use is made of A1050 and A1100. As for the aluminum-containing composite material, use is made of metal/ceramics composite materials such as aluminum/alumina, aluminum/aluminum nitride, aluminum/silicon carbide, aluminum/silicon nitride, and aluminum/silicon oxide, or metal composite materials such as aluminum/nickel, aluminum/titanium, and aluminum/magnesium. Further, it is also possible to use a composite material in which a surface of the substrate made of metal, ceramics and composite materials thereof is coated by aluminum or aluminum alloy.

The surface nitriding member according to the invention is produced for example as follows. A predetermined substrate is set on a sample base in a chamber with a vacuum apparatus. Then, an atmosphere in the chamber is discharged by means of a vacuum pump to a vacuum level not less than $10^{-3}$ torr preferably not less than $5\times10^{-4}$ torr. Then, the substrate is heated by means of a beating apparatus such as a resistor heater or an infrared lamp provided in the chamber to a temperature not less than 500° C. preferably 540–600° C. Then, the substrate is kept at this temperature for 1–10 hours to perform a heat treatment.

After the heat treatment, $N_2$ gas, $NH_3$ gas or mixed gas thereof is introduced into the chamber in which the vacuum state is maintained so as to make atmosphere in the chamber to nitrogen atmosphere. Then, a pressure in the chamber is set to not less than 2 kg/cm$^2$ preferably 5–10 kg/cm$^2$. At the same time, at least one element other than aluminum selected from Group 2A, Group 3A, Group 4A and Group 4B in Periodic Table is introduced into the chamber, and the thus introduced element is existent in the chamber together with the nitrogen atmosphere.

As for the element mentioned above, use is made of a single metal such as magnesium and strontium, and further use may be made of A606 1 (Mg—Si alloy), A7075 (Zn—Mg alloy) and A5083 (Mg Alloy). Among them, it is preferred to use a magnesium single metal or an alloy containing magnesium. Thereby, the nitriding on the substrate surface is promoted and a thick and dense nitriding portion can be formed for a relatively short time interval. In this case, the nitriding portion of the surface nitriding member according to the invention contains magnesium.

Then, the substrate is kept at a temperature not less than 550° C. preferably 540–600° C. for 1–30 hours to perform a heating and nitriding treatment. Then, after a predetermined time elapses at the temperature keeping step, the element mentioned above is transferred to a portion having a low temperature in a nitriding treatment furnace. Also in this case, since a formation of aluminum nitride on a surface of the substrate is performed continuously, it is possible to form the thick and dense nitriding portion having aluminum nitride as a main ingredient.

Moreover, after the element is transferred to the portion having a low temperature in the nitriding treatment furnace, since there is no element in the chamber which performs the heating and nitriding treatment, a concentration of the element at the surface portion of the nitriding portion is decreased.

In this manner, the element mentioned above can be existent stepwise in the nitriding portion. Then, the nitriding portion can be constructed by the high concentration region positioned at the substrate side in which the element is contained at a high concentration and the low concentration region at the surface side in which the element is contained at a low concentration.

Further, in the case that the nitriding portion is formed thick at a level of 20 μm, it is not necessary to transfer the element to an another portion so as to obtain the nitriding portion in which a concentration of the element is low at the surface side. This is because a surface of the element such as a single metal or an alloy mentioned above is nitrided and an evaporation of the element can be prevented due to the thus nitrided stable surface. Then, in this case, it is generally possible to form the nitriding portion in which the element is existent stepwise.

In this case, the thus nitrided surface of the element such as a single metal can be removed during the heating treatment in vacuum for producing the next surface nitriding member. Therefore, the element such as a single metal can be used continuously for producing the surface nitriding portion according to the invention.

After a predetermined time elapses, the heating is stopped and the nitrogen gas introducing is also stopped so as to finish the heating and nitriding treatment. After that, the furnace is cooled down and the substrate is picked up from the furnace outward.

Hereinafter, actual examples will be explained.

EXAMPLE 1

(Production of Surface Nitriding Member)

As a substrate, use was made of aluminum (A1050: Al containing amount>99.5%) having a dimension of 50×50×2 mm. As the at least one element other than aluminum selected from Group 2A, Group 3A, Group 4A and Group 4B in Periodic Table, use was made of Mg—Si based aluminum alloy (A6061) having the same dimension as that of the substrate mentioned above.

Then, after the substrate and the alloy were set in a graphite sheath in an electric furnace made of graphite heater, an atmosphere in the electric furnace was discharged by means of a vacuum pump to a vacuum degree of $2\times10^{-4}$ torr. Then, the substrate was heated to a temperature of 540° C. by passing current through the heater, and was maintained at this temperature for 2 hours so as to perform a heating treatment.

Then, $N_2$ gas was introduced into the electric furnace in such a manner that a pressure in the furnace became 9.5 kg/cm$^2$. After that, the $N_2$ gas was introduced into the electric furnace at a rate of 2 L/min., and a control was effected to adjust the pressure in the furnace at the set level±0.05 kg/cm$^2$. After that, the substrate was maintained at 540° C. for 1 hour to perform a heating and nitriding treatment, and a nitriding portion made of aluminum nitride was formed on a surface of the substrate.

After that, when a temperature in the furnace was cooled to 50° C. or less, the thus obtained member was pulled out from the electric furnace. (Property evaluation of surface nitriding member)

The surface of the thus obtained member showed a black color. Moreover, an inspection of the construction of the member was effected by XRD, and peaks of aluminum nitride were observed. That is to say, it was found that the member obtained according to this example had a nitriding portion made of aluminum nitride.

Moreover, a cross section of the member was observed by SEM and a thickness of the nitriding portion was measured. As a result, the thickness thereof was 85 $\mu$m. Further, a composition analysis by EPMA was effected with respect to a cross section of the member, and a mapping of composition distribution was effected. As a result, a chart as shown in FIG. 1 was obtained.

As clearly seen from FIG. 1, a concentration of magnesium was varied stepwise in the nitriding portion, and it was understood that magnesium was existent little or nothing at a surface side of the nitriding portion. That is to say, it is understood that the nitriding portion had a high concentration region in which magnesium or the like was contained at a high concentration and a low concentration region in which magnesium or the like was contained at a low concentration. Moreover, a thickness of the low concentration region was 60 $\mu$m.

Then, an amount of magnesium was measured by EDS. As a result, it was found that a concentration of magnesium in the entire nitriding portion was 0.41 wt % and that a concentration of magnesium in the low concentration region was 0.20 wt %.

Further, an average surface roughness along center line of the surface of the thus obtained member was measured by a surface roughness measuring apparatus made of Taylor Hobson Ltd. As a result, it was found that the average surface roughness along center line was 0.7 $\mu$m. The results were summarized in the following Table 1. (Corrosion resistance test)

The member mentioned above was exposed under a corrosive gas atmosphere having a high temperature so as to perform a corrosion resistance test. As the corrosive gas, use was made of a mix gas made of $NF_3$ gas 75 sccm/ $N_2$ gas 100 sccm. The corrosive gas was heated to a temperature of 550° C. under a pressure of 0.1 torr, and was exited by applying RF power of 1000 W. Then, the member was contacted to the corrosive gas mentioned above for 5 hours, so that a weight variation before and after the corrosion resistance test was +0.18 g/cm$^2$.

EXAMPLE 2

In this example 2, the member was produced in the same manner as that of the example 1 except that the vacuum degree during the heating treatment was $1.9\times10^{-4}$ torr, the heating temperature was 540° C., the pressure in the furnace during the heating and nitriding treatment was 5.0 kg/cm$^2$ and the heating time interval was 2 hours.

Properties of the thus obtained member was investigated in the same manner as that of the example 1, so that the results shown in the following Table 1 were obtained. Also in this example 2, it was found that the nitriding portion made of aluminum nitride as a main ingredient was formed on the surface of the member. Further, the nitriding portion had the high concentration region in which magnesium was existent at a high concentration and the low concentration region in which magnesium and silicon were existent at a low concentration.

Furthermore, the corrosion resistance test was performed in the sama manner as that of the example 1, so that the weight variation before and after the corrosion resistance test was +0.25 g/cm$^2$.

EXAMPLE 3

In this example 3, the member was produced in the same manner as that of the example 1 except that the vacuum degree during the heating treatment was $3.5\times10^{-4}$ torr, the heating temperature was 600° C. and the heating time interval was 2 hours.

Properties of the thus obtained member was investigated in the same manner as that of the example 1, so that the results shown in the following Table 1 were obtained. Also in this example 3, it was found that the nitriding portion made of aluminum nitride as a main ingredient was formed on the surface of the member. Further, the nitriding portion had the high concentration region in which magnesium was existent at a high concentration and the low concentration region in which magnesium was existent at a low concentration.

Furthermore, the corrosion resistance test was performed in the sama manner as that of the example 1, so that the weight variation before and after the corrosion resistance test was +0.15 g/cm$^2$.

Comparative Example 1

In this comparative example 1, the corrosion resistance test was performed with respect to the substrate on which no nitriding portion was formed, and the corrosion resistance property of the substrate was evaluated. As the substrate, use was made of aluminum (A1050) having a dimension of 50×50×2 mm. Further, the corrosion resistance test was performed in the same manner as that of the example 1, so that the weight variation before and after the corrosion resistance test was 3.21 g/cm$^2$.

Comparative Example 2

In this comparative example 2, the member was produced in the same manner as that of the example 1 except that Mg—Si base aluminum alloy (A6061) having a dimension of 50×50×2 mm was used as the substrate and at least one element other than aluminum selected from for example Group 2A in Periodic Table was not existent.

As is the same as the example 1, a surface of the thus obtained member was black. Moreover, a surface construction of the member was investigated by XRD. As a result, peaks of aluminum nitride were observed.

Further, a cross section of the member was observed by SEM. As a result, a thickness of the nitriding portion was 20 $\mu$m. Furthermore, a composition of the cross section of the member was analyzed by EPMA and EDS. As a result, it was found that magnesium was uniformly existent in the nitriding portion. Moreover, an amount of magnesium in the nitriding portion was 4.6 wt %.

Further, the corrosion resistance test was performed in the same manner as that of the example 1, so that the weight variation before and after the corrosion resistance test was +0.62 g/cm$^2$.

TABLE 1

| | Thickness of nitriding portion (μm) | Thickness of low concentration region (μm) | Mg concentration in low concentration region (wt %) | Weight variation of member before and after anti-corrosion test |
|---|---|---|---|---|
| Example 1 | 85 | 60 | 0.20 | +0.18 |
| Example 2 | 20 | 14 | 0.29 | +0.25 |
| Example 3 | 120 | 90 | 0.18 | +0.15 |
| Comparative example 1 | 0 | 0 | *<0.05 | +3.21 |
| Comparative example 2 | 20 | 0 | *4.6 | +0.62 |

*denotes Mg concentration contained in overall nitriding portion

As can be clearly understood from the examples and the comparative examples, if the nitriding portion comprises the high concentration region in which magnesium and silicon are existent at a high concentration and the low concentration region in which theses elements are existent at a low concentration according to the invention and if a concentration of magnesium is lowered at the surface of the nitriding portion, it is found that an extremely high corrosion resistance property can be exhibited.

As mentioned above, according to the invention, the surface nitriding portion in which a concentration of at least one element other than aluminum selected from Group 2A, Group 3A, Group 4A and Group 4B in Periodic Table is low at its surface portion. Therefore, it is possible to form the thick and dense nitriding portion, and a concentration of the element which show a low corrosion resistance property with respect to the halogen-based corrosive gas is lowered at the surface portion of the nitriding portion. In this manner, the surface nitriding member according to the invention shows an extremely high corrosion resistance property with respect to the halogen-based corrosive gas.

What is claimed is:

1. A surface nitriding member comprising a substrate made of metallic aluminum, aluminum alloy or aluminum-containing composite material, and a nitriding portion formed by nitriding a surface portion of the substrate, wherein the nitriding portion contains at least one element other than aluminum selected from Group 2A, Group 3A, Group 4A and Group 4B in Periodic Table and wherein (1) a concentration of the element at a surface side of the nitriding portion is lower than that of the element at a substrate side of the nitriding portion, (2) the concentration of the element in the nitriding portion is varied stepwise from the substrate side to the surface side, (3) the nitriding portion comprises a high concentration region positioned at the substrate side thereof in which the element is contained at a high concentration and a low concentration region positioned at the surface side thereof in which the element is contained at a low concentration, and (4) a concentration of the element in the low concentration region is not more than 0.5 wt %.

2. The surface nitriding member according to claim 1, wherein a thickness of the low concentration region is not less that one third of a thickness of the high concentration region.

3. The surface nitriding member according to claim 1, wherein a thickness of the nitriding portion is not less than 10 μm.

4. The surface nitriding member according to claim 1 wherein a concentration of the element in the nitriding portion is not more than 1 wt %.

5. The surface nitriding member according to claim 1, wherein an average surface roughness along center line of the surface of the nitriding portion is not more than 1.6 μm.

6. The surface nitriding member according to claim 1, wherein the element is magnesium.

* * * * *